US005092065A

United States Patent [19]

Teng

[11] Patent Number: 5,092,065

[45] Date of Patent: Mar. 3, 1992

[54] DISPLAY DEVICE HAVING DOUBLY ROTATABLE DECORATIVE ARTICLES

[76] Inventor: Hsieh-Yi Teng, c/o Hung Hsing Patent Service Center, P.O. Box 55-1670, Taipei (10477), Taiwan

[21] Appl. No.: 624,016

[22] Filed: Nov. 29, 1990

[51] Int. Cl.[5] ..... G09F 19/00

[52] U.S. Cl. ..... 40/410; 40/411

[58] Field of Search ..... 40/411, 410, 409, 414, 40/406, 470, 426, 429, 430, 431; 272/31 R

[56] References Cited

U.S. PATENT DOCUMENTS 1,681,310 8/1928 Reiner ..... 272/31 R
1,799,852 4/1931 Jones ..... 40/406
2,590,279 3/1952 Soss ..... 40/406
4,363,181 12/1982 Hyman et al. ..... 272/31 R
4,852,283 8/1989 Teng ..... 40/410

*Primary Examiner*—Kenneth J. Dorner
*Assistant Examiner*—Cassandra Hope

[57] ABSTRACT

A display device includes a crystal ball held on a base having an upper decorative article rotatably mounted in a top plug formed on an upper portion of the crystal ball, and a lower decorative article mounted on a packing disk rotatably mounted in the base, so that both upper and lower decorative articles are rotatable either in a same direction or different directions, for enhancing decorative interest and increasing diversified features.

6 Claims, 4 Drawing Sheets

DISPLAY DEVICE HAVING DOUBLY ROTATABLE DECORATIVE ARTICLES

BACKGROUND OF THE INVENTION

A conventional water ball such as disclosed in U.S. Pat. No. 4,757,986 generally includes a spherical ball for providing a toy 3 inside the ball 1 which may be rotatable to increase its vividness. However, only one toy is rotatable in the ball, lacking of a three-dimensional decorative effect.

It is therefore expected to disclose a display device such as a crystal ball having an upper decorative article rotatable with respect to a lower rotatable decorative article for enhancing a decorative effect.

SUMMARY OF THE INVENTION

The object of the present invention is to provide a display device including a crystal ball held on a base having an upper decorative article rotatably mounted in a top plug formed on an upper portion of the crystal ball, and a lower decorative article mounted on a packing disk rotatably mounted in the base, so that both upper and lower decorative articles are rotatable either in a same direction or different directions for enhancing decorative interest and increasing diversified features.

DETAILED DESCRIPTION

Figure 1:
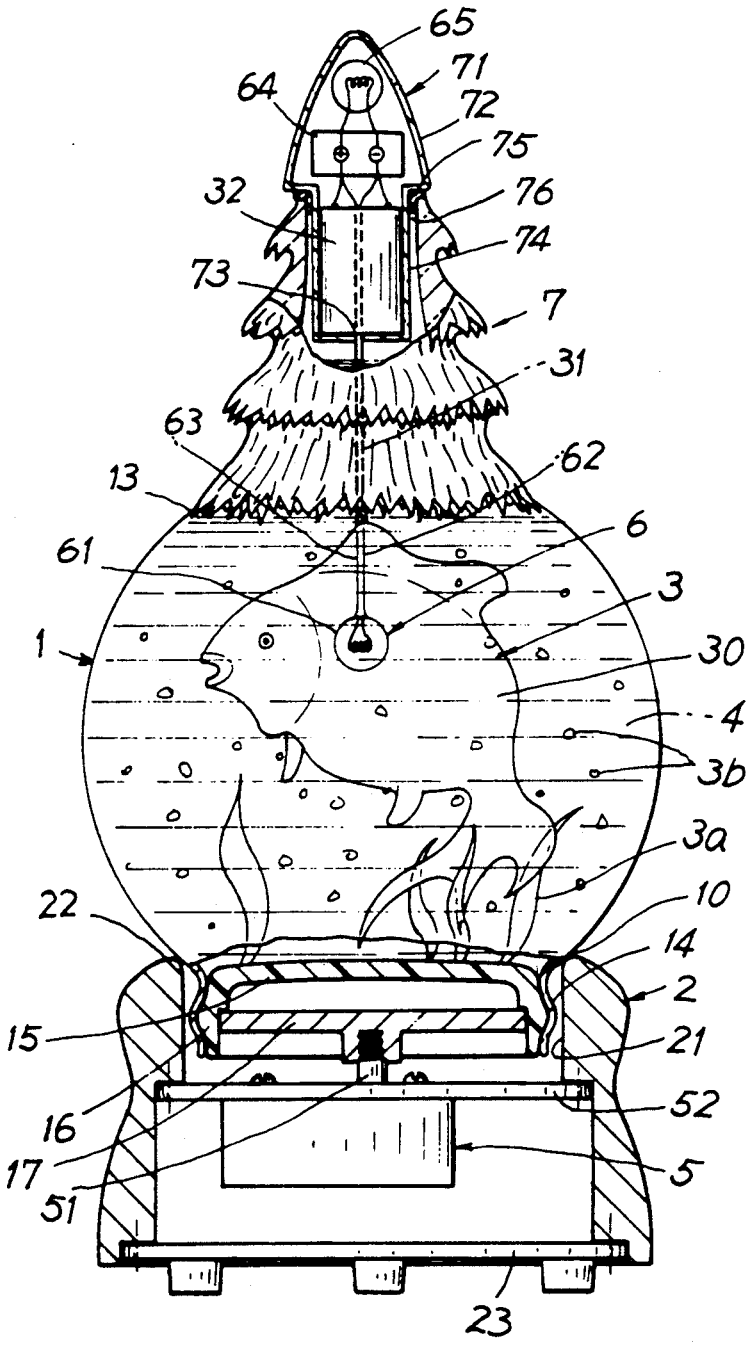
FIG. 1 is an illustration having a partial cut-away portion of the present invention.
Figure 2:
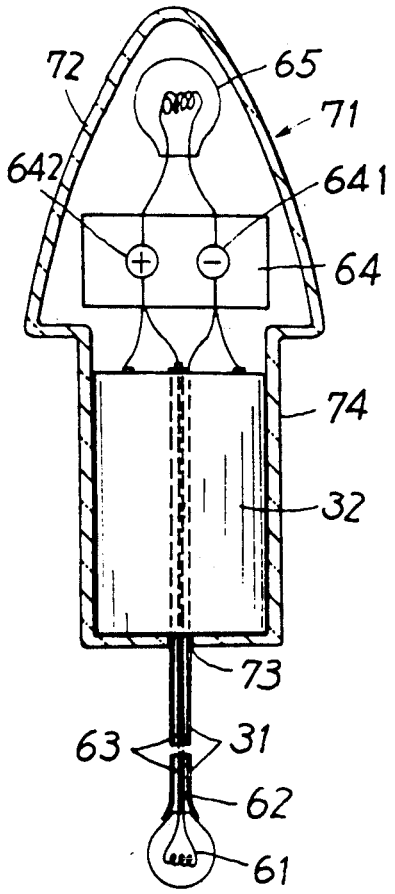
FIG. 2 shows an illuminating means of the present invention.

As shown in FIGS. 1, 2, the present invention comprises: a crystal ball 1, a base 2, an inner upper decorative means 3, an inner lower decorative means 3*a*, a free-moving decorative means 3*b*, a liquid water 4 filled in the ball 1, a main driving means 5, an illuminating means 6, and a top decorative means 7.

The crystal ball 1 generally formed as spherical shape or other shapes and formed as transparent includes: an upper portion 13 secured with or integrally formed with the top decorative means 7, a neck portion 14 formed on a lower portion of the ball 1, a packing disk 15 engaged with the neck portion 14 having a periphery extension 16 sealing an opening of the neck portion 14, and a supporting disk 17.

The base 2 includes: a central hole 21 formed through the base 2, an annular extension 22 formed on a top portion of the base 2 for rotatably supporting a lower tapered portion 10 of the ball 1, and a bottom plate 23 fixed on a bottom portion of the base 2.

The inner upper decorative means 3 includes: a suspended decorative feature 30 such as a fish as shown in FIG. 1, an upper hollow shaft 31 secured with the decorative features 30, and an upper electric motor 32 for rotating the shaft 31 and decorative feature 30. The suspended decorative feature 30 may be made transparent or translucent.

The inner lower decorative means 3*a* fixed on the packing disk 15 is touchable by the suspended decorative feature of the upper decorative means 3, for instance, a water grass 3*a* may be moved by the fish 30 as shown in FIG. 1 when both rotated. A free-moving decorative means 3*b* may be decorative debrises laden on water 4, such as for imitating bubbles in the crystal ball 1. In FIGS. 4–7, the inner lower decorative means 3*a* and the free-moving decorative means 3*b* are omitted from the aforementioned.

The driving means 5 may be secured inside the base 2 by fixing screws on a fixing plate 52 of the driving means 5. The driving means 5 may be selected from a spring system of a musical box and a lower electric motor powered by a lower power source (not shown) provided in the base 2.

Figure 2A:
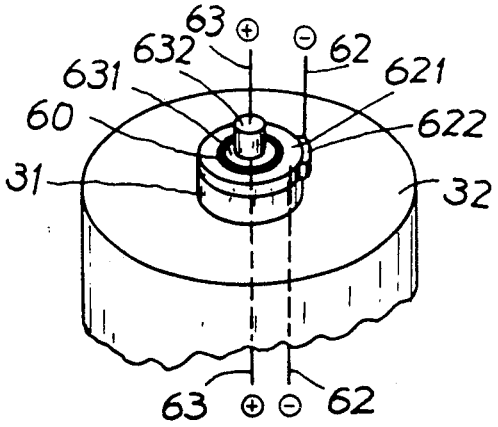
FIG. 2*a* shows a continuous lighting operation of the illuminating means of FIG. 2.
Figure 2B:
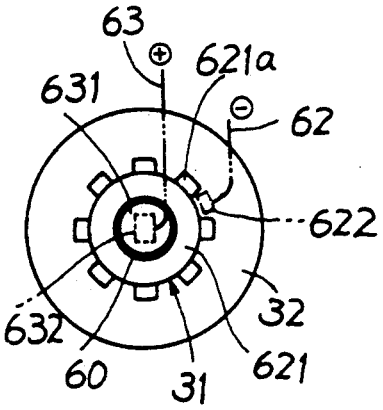
FIG. 2*b* shows an intermittent lighting of the illuminating means of FIG. 2.

The illuminating means 6 includes: a lower bulb 61 fixed in the suspended decorative feature 30, two wires 62, 63 electrically connecting the bulb 61 to an upper power source 64 such as a dry battery secured in a top plug 71, and a top bulb 65 also electrically connected to the power source 64, formed in a top portion in the plug 71. As shown in FIGS. 2, 2*a*, the two wires 62, 63 are respectively connected to the motor 32 and two rotational contactors 621, 631 concentrically formed on a bottom of the shaft 31 as shown in FIG. 2*a* partitioned by an insulator ring 60. Two stationary contactors 622, 632 are frictionally rotatably contacted with the two rotational contactors 621, 631, and are respectively connected to two poles 641, 642 of the power source 64. Other modifications of the illuminating means 6 and its power connection can be made in this invention. As shown in FIG. 2*b*, one outer contactor 621 of the two rotational contactors 621, 631 includes a plurality of electrically conductive dots 621*a* intermittently formed along the conductive outer contactor 621 concentric to an axis of the shaft 31 and concentrically disposed around an inner contactor 631 for flashing the bulb 61 when rotating the decorative feature 30.

The top decorative means 7 includes: a top decorative article formed or integrally formed on the upper portion 13 of the ball 1 such as a church, a Santa Claus, an ice pillar, a pumpkin respectively shown in FIGS. 4, 5, 6 and 7; and a top plug 71 sealing a top opening 76 formed on a top portion of the decorative means 7 by packing 75 for filling water 4 into the ball 1 when removing the plug 71.

The top plug 71 includes: an upper bulb shade 72 for mounting the top bulb 65 in the shade 72, and a lower plug portion 74 inserted in the top opening 76 by the packing 75 having a bottom central hole 73 for rotatably mounting the shaft 31.

In using the present invention, the water is filled into the ball 1 through the top opening 76. The top bulb 65 may be lit to illuminate the top plug 71.

The ball 1 may be held and rotated about the base 2 to store elastic energy of a spring system of a musical box of the driving means 5. Then the base 2 is laid on a table surface to rotate the ball 1, the top decorative means 7, plug 71 and the inner lower decorative means 3*a* about the lower shaft 51. At this time, the upper motor 32 is also driven to rotate the upper shaft 31 and suspended decorative feature 30, thereby impacting the lower decorative means 3*a* to wipe, push or move the lower means 3*a* to agitate the free-moving decorative means 3*b*. As illustrated in FIG. 1, a fish is now served as the suspended decorative feature 30, water grass served as the lower decorative means 3*a* so that the rotation of upper fish (30) will move the lower water grass (3*a*) to agitate the free-moving decorative means 3*b* to imitate bubbling of bubbles (3*b*) so as to form a vivid phenomena for enhancing the decorative effect, which is superior to any conventional crystal or water ball.

The lower bulb 61 will be flashed as shown in FIG. 2*b* as intermittent contact between the dotted contactor 621 and the stationary contactor 622 (another contactor 631 always contacting another stationary contactor 632). If the contactors are arranged as shown in FIG. 2*a*, the bulb 61 will be continously lit, unless switching off the power source 64.

Figure 3:
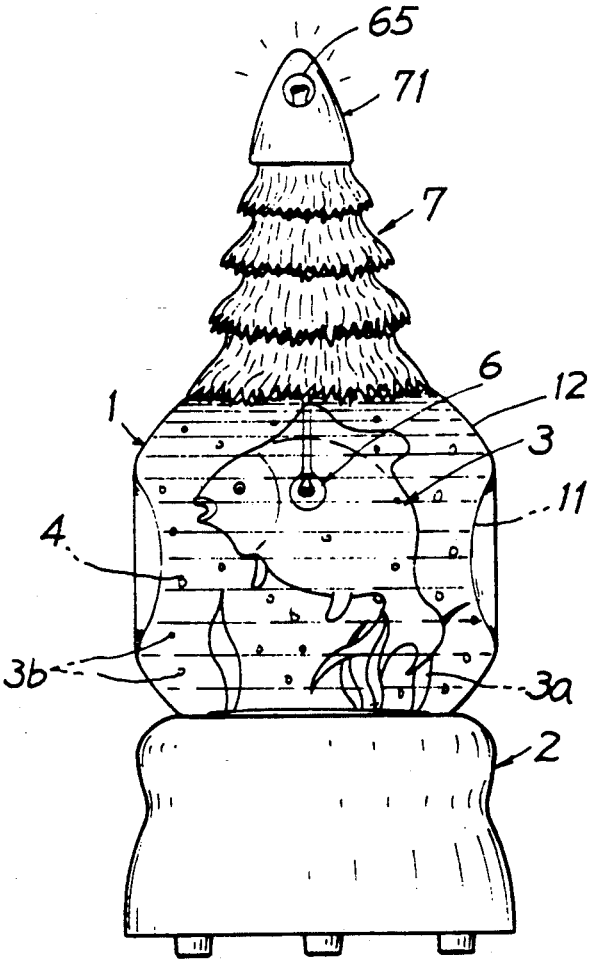
FIG. 3 shows another preferred embodiment of the present invention.
Figure 4:
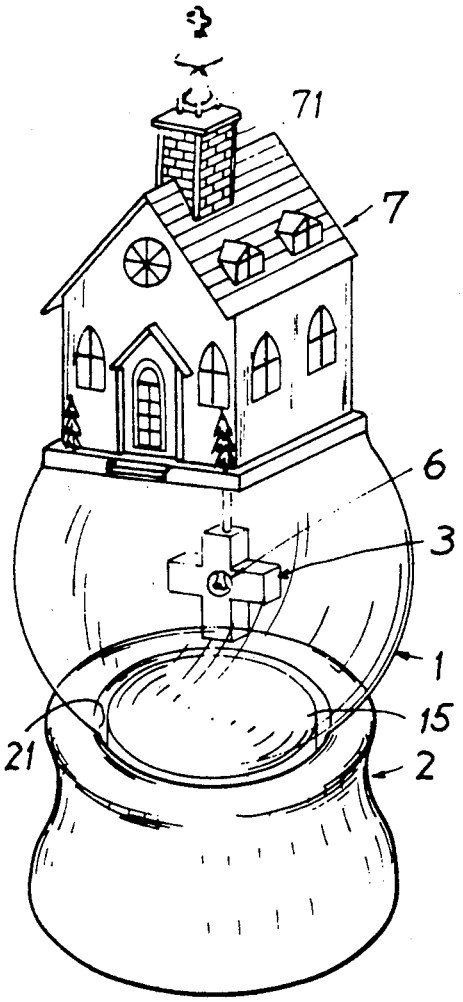
FIG. 4 shows still another preferred embodiment of the present invention.
Figure 5:
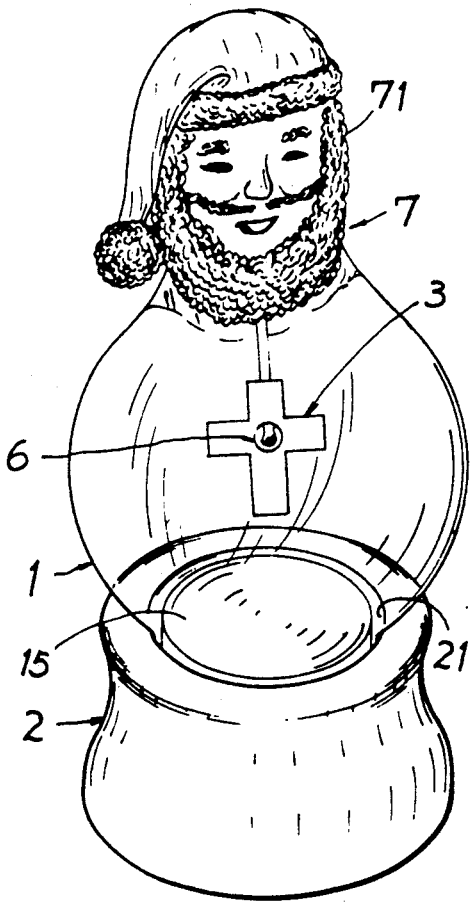
FIG. 5 is an illustration showing further embodiment of the present invention.
Figure 6:
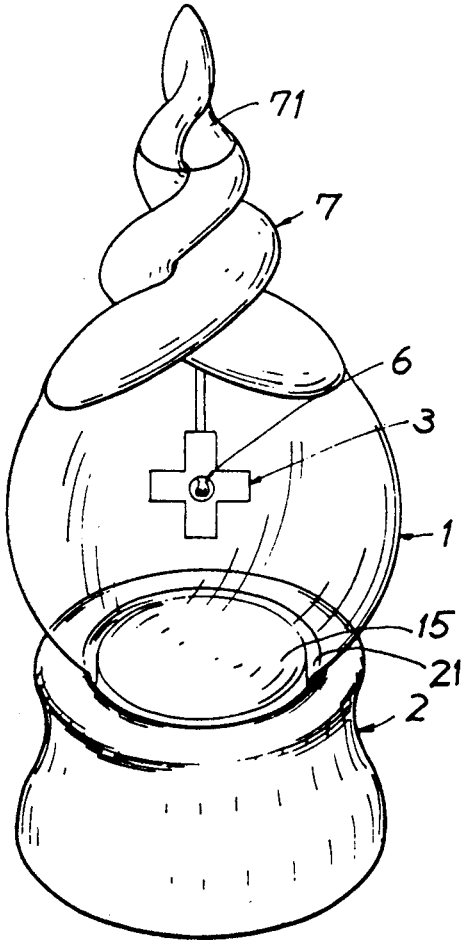
FIG. 6 shows still further embodiment of the present invention.
Figure 7:
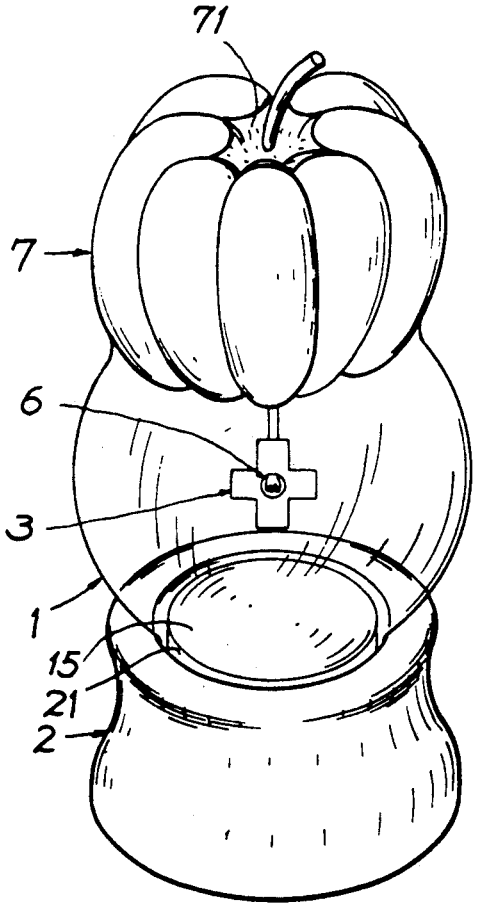
FIG. 7 shows another embodiment of the present invention.

The present invention may also be modified to be a concave and convex ball 1 fixed on a base 2 as shown in FIG. 3, having a plurality of concave portions 11 and convex portions 12 formed on a surface of the ball to serve as concave lens for contracted image or serve as convex lens for magnified image when viewing the decorative feature through the ball 1 filled with water 4.

I claim:

1. A display device comprising:

a crystal ball made of transparent material having a neck portion formed on a lower portion of said ball sealed with a packing disk secured on a supporting disk;

a base having a central hole for mounting said neck portion formed on a lower portion of said crystal ball and an annular extension formed on a top portion of said base for rotatably supporting said crystal ball;

a first decorative means held in said crystal ball including a suspended decorative feature mounted on an upper shaft rotatably driven by an upper motor;

a second decorative means secured on said packing disk;

a third decorative means which is a free-moving decorative means movably stored in said ball;

a main driving means including a lower electric motor powered by a lower power source, said lower electric motor and said lower power source being fixed in said base having a lower shaft of said lower electric motor secured with said supporting disk for rotating said packing disk secured on said supporting disk and for rotating said second decorative means and said ball secured with said packing disk;

an illuminating means having a lower bulb fixed in said suspended decorative feature and electrically connected to an upper power source for illuminating said lower bulb, and a top bulb also electrically connected to said upper power source;

a fourth decorative means which is a top decorative means integrally formed on an upper portion of said crystal ball having a top plug removably sealing a top opening formed in said fourth decorative means, said top opening extending through said fourth decorative means and said crystal ball, both said upper motor and said top bulb formed in said top plug to be respectively powered by said upper power source; and a liquid water filled in said crystal ball through said top opening when removing said top plug, whereby upon a driving of said main driving means and a rotation of said upper shaft driven by said upper motor, said first decorative means will rotate with respect to a rotating second decorative means to move said second decorative means and said third decorative means for enhancing a vivid decorative effect of the crystal ball.

2. A display device according to claim 1, wherein said top plug of said fourth decorative means includes: an upper bulb shade said, a top bulb formed in said upper shade electrically connected to said upper power source, and a lower plug portion inserted in said top opening formed on an upper portion of said fourth decorative means and said ball as packed by a packing.

3. A display device according to claim 1, wherein said suspended decorative feature of said first decorative means is secured to said a hollow upper shaft rotatably mounted on said upper motor through a central hole formed in said top plug and operatively rotating in said ball for moving said first decorative means for agitating and floating said third decorative means formed as debrises laden in said water in said ball.

4. A display device according to claim 1, wherein said crystal ball is selected from a spherical ball and a ball having concave and convex portions formed on a surface of said ball.

5. A display device according to claim 1, wherein said illuminating means includes two upper wires of said upper power source connected to two stationary contactors, said two stationary contactors frictionally rotatably contacting two rotational contactors formed on an upper end portion of said upper shaft for electrically contacting two lower wires connected to said lower bulb fixed in said suspended decorative feature.

6. A display device according to claim 5, wherein one of said two rotational contactors is made as intermittent electric contact with one pole of said upper power source for flashing said lower bulb when rotating said upper shaft.

* * * * *